US010553983B2

(12) United States Patent
Mito et al.

(10) Patent No.: US 10,553,983 B2
(45) Date of Patent: Feb. 4, 2020

(54) CONNECTOR HOUSING WITH A REDUCED WARPAGE

(71) Applicants: Tyco Electronics Japan G.K., Kanagawa (JP); Toyota Jidosha Kabushiki Kaisha, Aichi (JP)

(72) Inventors: Yusuke Mito, Kanagawa (JP); Takayuki Naito, Aichi (JP); Akinobu Murakami, Aichi (JP)

(73) Assignees: Tyco Electronics Japan G.K., Kanagawa (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 16/031,324

(22) Filed: Jul. 10, 2018

(65) Prior Publication Data

US 2018/0323533 A1 Nov. 8, 2018

Related U.S. Application Data

(63) Continuation of application No. PCT/JP2017/001423, filed on Jan. 17, 2017.

(30) Foreign Application Priority Data

Jan. 18, 2016 (JP) ..... 2016-006822

(51) Int. Cl.
*H01R 13/518* (2006.01)
*H01R 13/514* (2006.01)
*H01R 25/00* (2006.01)

(52) U.S. Cl.
CPC ..... *H01R 13/518* (2013.01); *H01R 13/514* (2013.01); *H01R 25/006* (2013.01)

(58) Field of Classification Search
CPC .... H01R 13/518; H01R 13/514; H01R 13/50; H01R 25/006; H01R 24/60
(Continued)

(56) References Cited

U.S. PATENT DOCUMENTS 3,328,229 A * 6/1967 Windecker ..... B29C 70/86 156/177
5,161,997 A * 11/1992 Defibaugh ..... H01R 13/518 248/222.51
(Continued)

FOREIGN PATENT DOCUMENTS

JP 3778555 B2 3/2006
JP 2007-87874 A 4/2007
JP 201246621 A 3/2012

OTHER PUBLICATIONS

International Search Report, dated Feb. 1, 2017, 2 pages.
(Continued)

*Primary Examiner* — Harshad C Patel
(74) *Attorney, Agent, or Firm* — Barley Snyder

(57) ABSTRACT

A connector housing comprises a mating portion including a plurality of mating hoods that are arranged in a width direction on a front side of the connector housing that is configured to be mated with a mating connector and a rear structure portion disposed posterior to the mating portion. The rear structure portion includes a plurality of structure parts each disposed between two mating hoods adjacent to each other of the plurality of mating hoods and a plurality of notches each disposed between two structure parts adjacent to each other of the plurality of structure parts.

10 Claims, 4 Drawing Sheets

(58) Field of Classification Search
USPC ..... 439/540.1, 541.5, 368, 590, 607.25, 439/607.18, 628, 649, 660, 709, 76.1, 439/119, 228, 235
See application file for complete search history.

(56) References Cited

U.S. PATENT DOCUMENTS 5,611,711 A * 3/1997 Okada ..... H01R 13/6592 439/607.08
5,658,154 A * 8/1997 Bumsted ..... H01R 12/725 439/532
5,879,199 A * 3/1999 Belopolsky ..... H01R 13/518 439/701
6,123,564 A * 9/2000 Belmore, III ..... H01R 13/518 324/538
6,953,357 B2 * 10/2005 Fukushima ..... H01R 13/5219 439/271
7,029,286 B2 * 4/2006 Hall ..... H01R 13/506 439/357
7,303,432 B1 * 12/2007 Chen ..... H01R 13/518 439/540.1
7,311,550 B2 * 12/2007 Hammond, Jr. ... H01R 13/6461 439/540.1
7,322,842 B2 * 1/2008 Duck ..... G02B 6/381 200/51.03
8,585,437 B2 * 11/2013 Lin ..... H01R 13/518 439/532
10,236,620 B2 * 3/2019 Kono ..... H01R 13/5202
2004/0097107 A1 5/2004 Motojima et al.
2007/0184701 A1 * 8/2007 Yagome ..... H01R 13/506 439/271
2015/0226926 A1 * 8/2015 Ogren ..... G02B 6/3825 385/88

OTHER PUBLICATIONS

Abstract of JP3778555, dated May 24, 2006, 1 page.
Korean Notification of Reason for Refusal with English translation, Korean Patent Application No. 10-2018-7018650, dated Jul. 22, 2019, 10 pages.

* cited by examiner

FIG. 3A
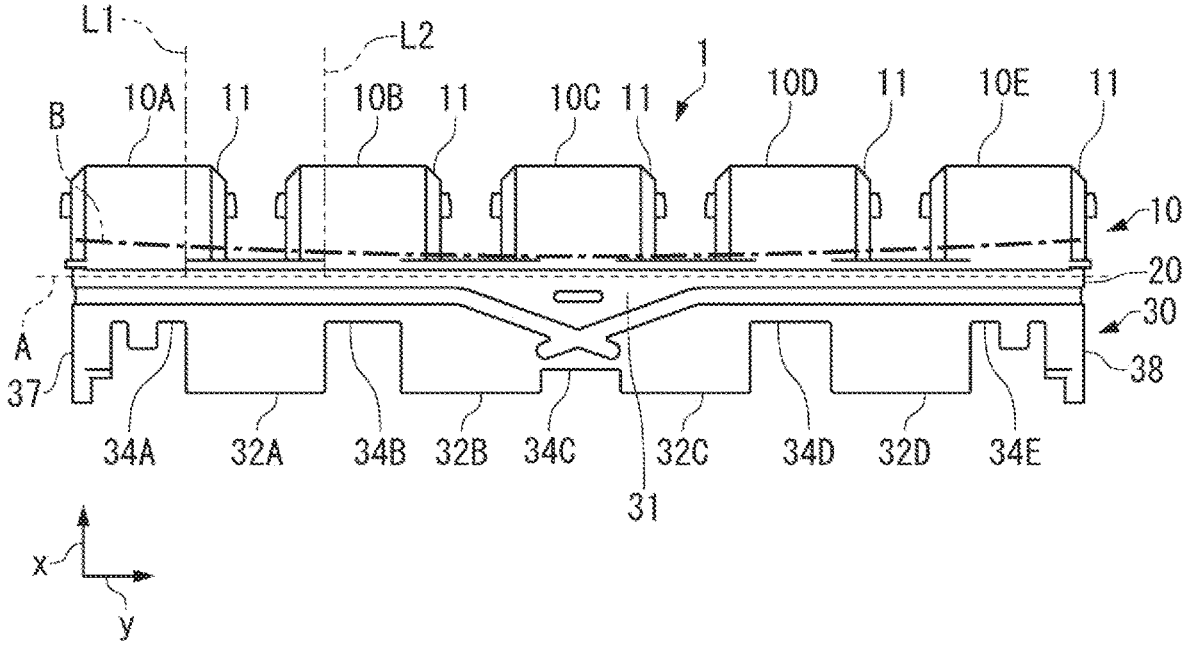
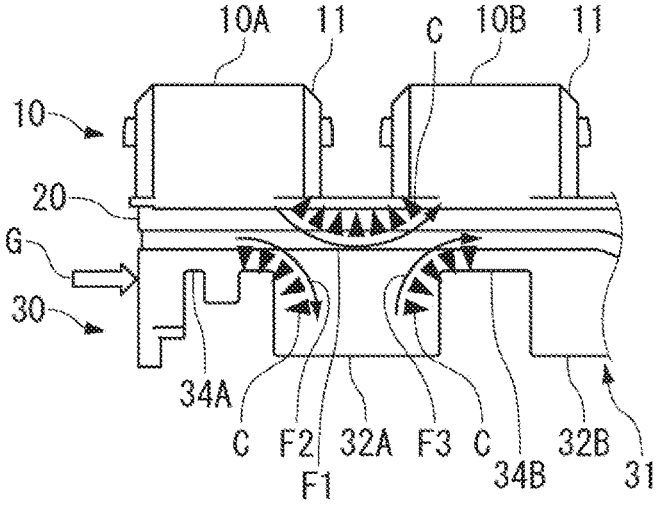
FIG. 3B

FIG. 4A
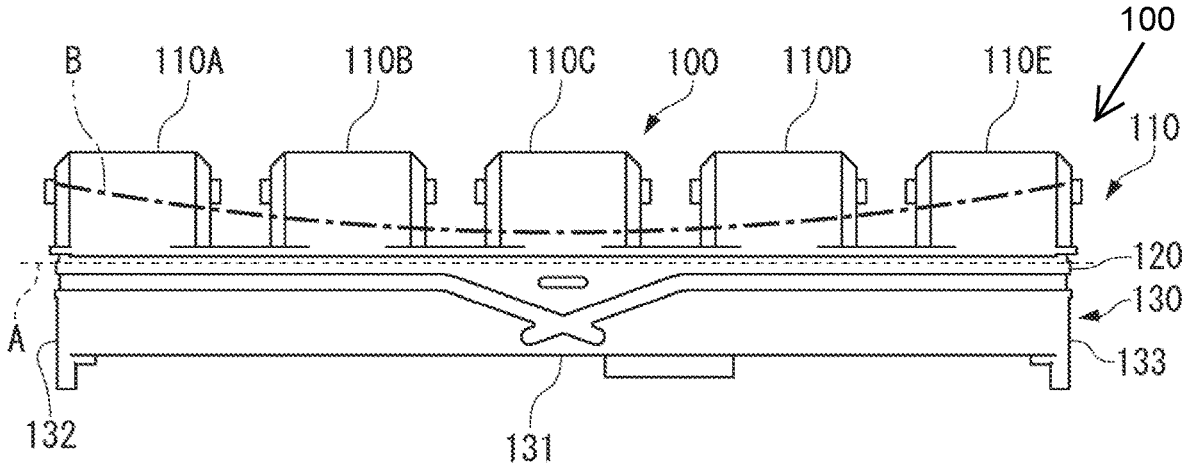
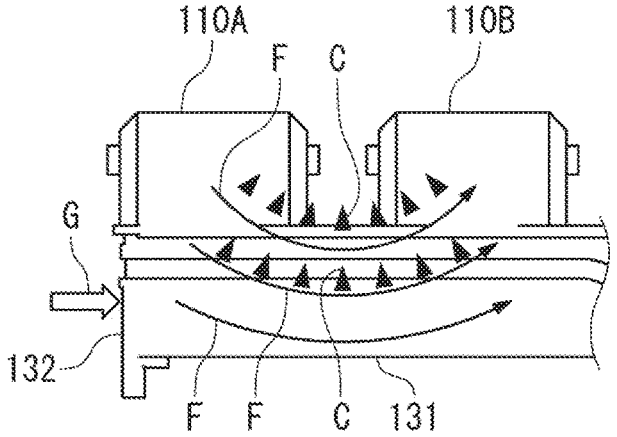
FIG. 4B

CONNECTOR HOUSING WITH A REDUCED WARPAGE

CROSS-REFERENCE TO RELATED APPLICATIONS

This application is a continuation of PCT International Application No. PCT/JP2017/001423, filed on Jan. 17, 2017, which claims priority under 35 U.S.C. § 119 to Japanese Patent Application No. 2016-006822, filed on Jan. 18, 2016.

FIELD OF THE INVENTION

The present invention relates to a housing of an electrical connector and, more particularly, to a connector housing with a reduced warpage.

BACKGROUND

A connector housing of an electrical connector is fabricated through injection molding of an electrically insulating synthetic resin. Warpage commonly occurs on an injection-molded product due to stress occurring inside the molded product. When warpage occurs on the connector housing, defective conditions, for example, insufficient assembling accuracy to a chassis or impossibility of mating with a mating connector housing, occur.

To reduce warpage of the connector housing, as disclosed in Japanese Patent Application No. 2007-87874 A, a wall part on which the warpage occurs is increased in thickness as compared with other parts. Increasing the thickness is effective for reduction of the warpage of the connector housing, however, in some applications of the connector housing, an increase in thickness alone is insufficient to reduce warpage. In particular, in a case where the connector housing has a large dimension in the width direction and includes a plurality of mating parts that are mated with mating electrical connectors, it is difficult to compensate the warpage.

SUMMARY

A connector housing comprises a mating portion including a plurality of mating hoods that are arranged in a width direction on a front side of the connector housing that is configured to be mated with a mating connector and a rear structure portion disposed posterior to the mating portion. The rear structure portion includes a plurality of structure parts each disposed between two mating hoods adjacent to each other of the plurality of mating hoods and a plurality of notches each disposed between two structure parts adjacent to each other of the plurality of structure parts.

BRIEF DESCRIPTION OF THE DRAWINGS

The invention will now be described by way of example with reference to the accompanying Figures, of which:

FIG. 3A is a plan view of the connector housing of FIG. 1;

FIG. 3B is a detail plan view of the connector housing of FIG. 1;

FIG. 4A is a plan view of a connector housing according to a comparative example; and FIG. 4B is a detail plan view of the connector housing of FIG. 4A.

DETAILED DESCRIPTION OF THE EMBODIMENT(S)

Figure 1:
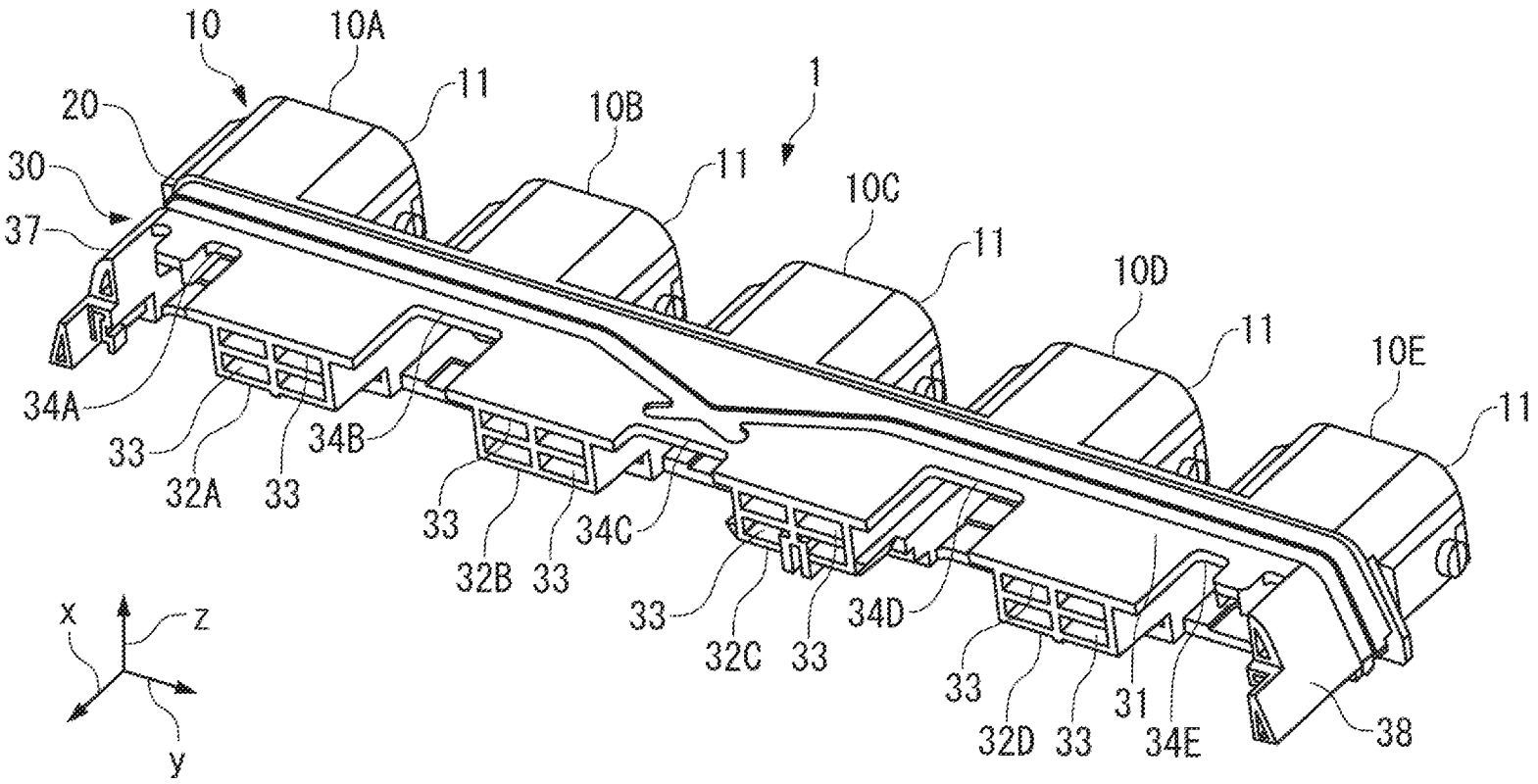
FIG. 1 is a perspective view of a connector housing according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

A connector housing 1 according to an embodiment is shown in FIGS. 1-4B. In the shown embodiment, the connector housing 1 is a female housing that holds a plurality of terminals and is integrally formed through injection molding of a resin. In an embodiment, fiber reinforced plastics (FRP) are used as the resin. In other embodiments, other resins may be used to mold the connector housing 1.

The connector housing 1, as shown in FIGS. 1 and 2A-2C, includes a mating portion 10 configured to be mated with a mating electrical connector, a holding portion 20 holding the terminals, and a cover 30 covering the terminals extending out of the holding portion 20. Occurrence of warpage is suppressed in the connector housing 1 through a configuration of the holding portion 20 described below. As shown by warpage line B in FIG. 3A, warpage of the connector housing 1 occurs in a front-rear direction x such that a center part of the mating portion 10 in a width direction y is recessed and a center part of the cover 30 in the width direction y is protruded.

Throughout the description of the connector housing 1, an x-axis direction shown in FIG. 1 is also referred to as the front-rear direction x, a y-axis direction is also referred to as the width direction y, and a z-axis direction is also referred to as a height direction z. In the front-rear direction x, a side on which the mating portion 10 is provided and the mating connector is mated is defined as front, and a side on which the cover 30 is provided and from which the terminals extend is defined as a rear.

As shown in the embodiment of FIGS. 1 and 2A-2C, the mating portion 10 includes five mating parts 10A-10E arranged in the width direction y. The five mating parts 10A-10E are arranged with equal gaps in the width direction y with the mating part 10C as a center. The mating parts 10A-10E have the same structure and dimensions. The mating parts 10A-10E each include a square-cylindrical mating hood 11 and a reception space 13 that occupies a space from an opening 12 located forward of the mating hood 11 to the holding portion 20. In other embodiments, the number of mating parts 10A-10E may vary and may include, for example, three or more mating parts 10A-10E.

Figure 2A:
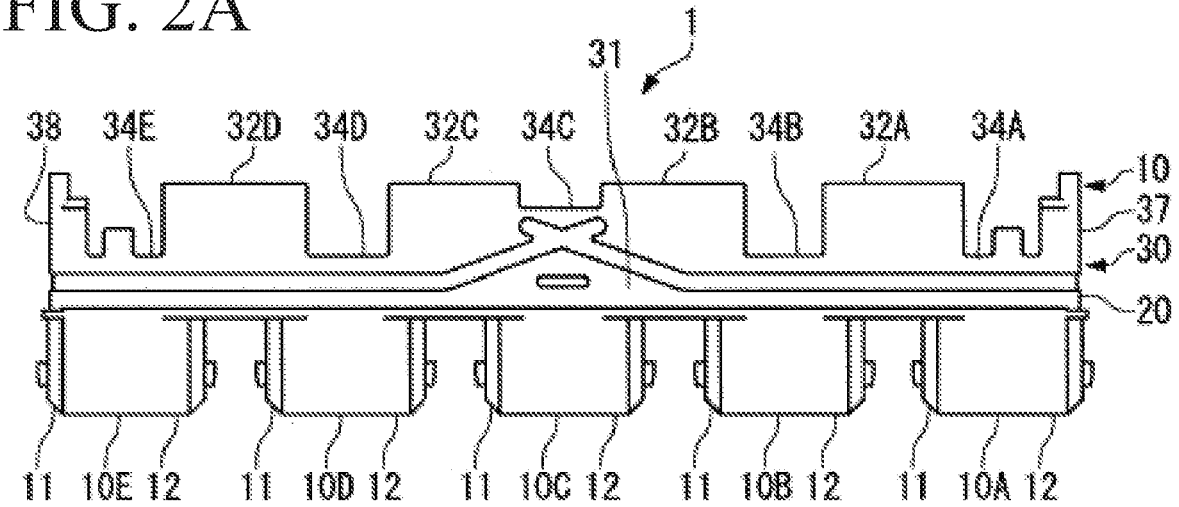
FIG. 2A is a plan view of the connector housing of FIG. 1.
Figure 2B:
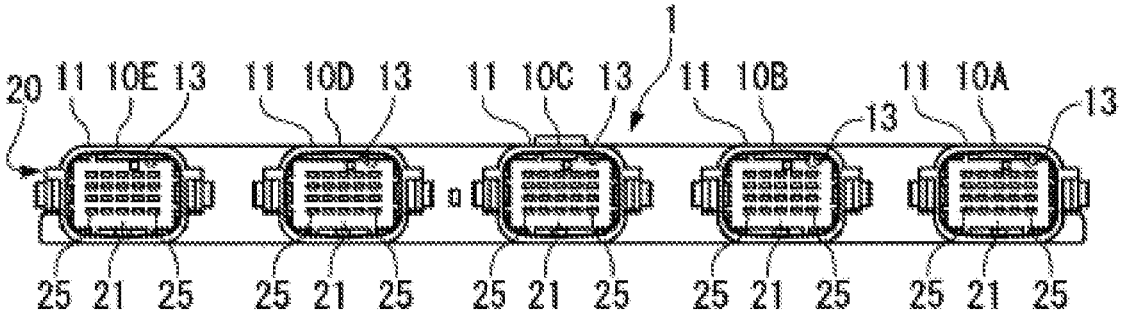
FIG. 2B is a front view of the connector housing of FIG. 1.
Figure 2C:
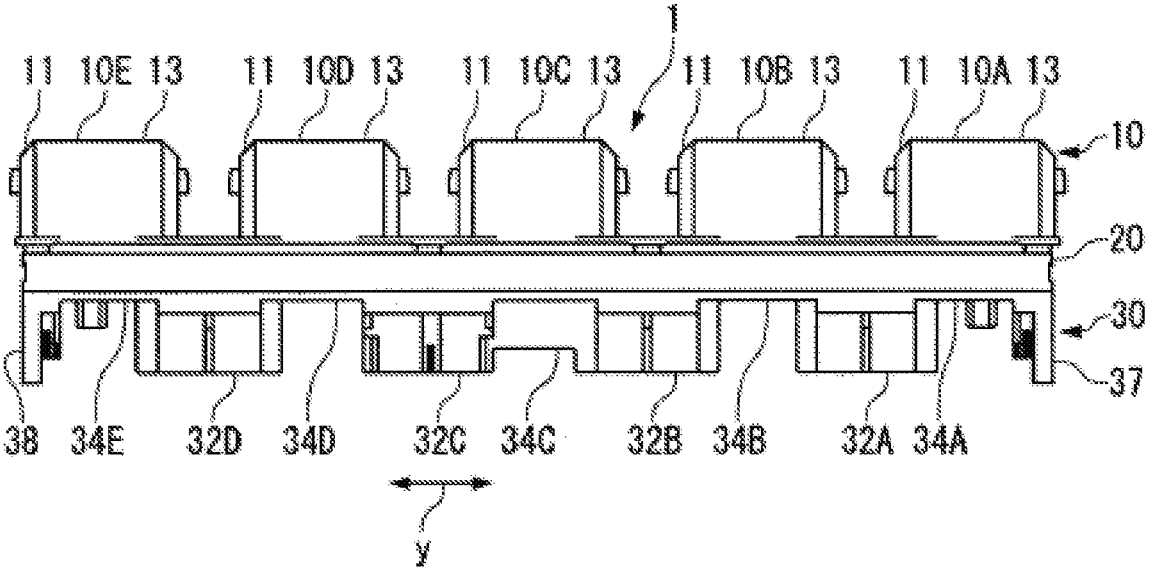
FIG. 2C is a bottom view of the connector housing of FIG. 1.

The holding portion 20, as shown in FIG. 2C, includes holding walls 21 and holding holes 25 provided in the holding walls 21. The terminals are press-fitted into the corresponding holding holes 25 to be held by the holding walls 21. Each of the holding walls 21 has a thickness that ensures a press-fit allowance sufficient to hold a press-fitted contact and includes a front surface directed forward and a rear surface directed rearward. Each of the holding holes 25 are provided so as to penetrate the front surface and the rear surface of the corresponding holding wall 21, corresponding to the position of the terminals to be held. The holding walls 21 provided with the holding holes 25 are disposed corresponding to the mating hoods 11 of the respective mating parts 10A-10E.

The cover 30 that communicates with the rear side of the holding portion 20 and configures a rear structure portion, as shown in FIG. 1, includes an upper structure 31, and a left side wall 37 and a right side wall 38 that are connected to the upper structure 31 at both sides in the width direction y. The terminals drawn rearward from the holding portion 20 are disposed inside the cover 30.

The upper structure 31 includes a plurality of structure parts 32, as shown in FIGS. 1, 2A, and 2C, that are provided with gaps in the width direction y, and notches 34 each disposed between structure parts 32 adjacent to each other. The structure parts are collectively denoted by the structure parts 32, and are distinctively denoted by structure parts 32A, 32B, 32C and 32D. Further, the notches are collectively denoted by the notches 34, and are distinctively denoted by notches 34A, 34B, 34C, 34D, and 34E. The structure parts 32A, 32B, 32C, and 32D are symmetrically disposed in the width direction y.

The structure parts 32 approximate a volume of the resin configuring the cover 30 disposed on the rear side with the holding portion 20 as a boundary, to a volume of the resin configuring the mating portion 10 disposed on the front side. In the connector housing 1, the volume of the mating portion 10 and the volume of the cover 30 are balanced to reduce warpage after injection molding.

Each of the structure parts 32 has a rectangular parallelepiped shape extending rearward from the holding portion 20, and as shown in FIG. 1, includes four lightening parts 33 at a front end thereof. The lightening parts 33 each include a rectangular opening and are arranged in a lattice form. Accordingly, each of the structure parts 32 includes a point-symmetrical surface along a y-z plane in FIG. 1 and is uniform in thickness around the lightening parts 33; this makes it possible to suppress deformation of the structure parts 32 themselves due to injection molding. In other embodiments, the structure parts 32 may be entirely solid, omitting the lightening parts 33; the form of the structure parts 32 is not limited as long as the structure parts 32 can balance the volume relative to the mating portion 10 and be made of the resin material configuring the connector housing 1.

The notches 34 control flow of melted resin so as to suppress occurrence of warpage when the connector housing 1 is manufactured through injection molding, thereby reducing occurrence of warpage.

The notches 34, as shown in FIGS. 1, 2A, and 2C, are disposed between the left side wall 37 and the structure part 32A, between the structure part 32A and the structure part 32B, between the structure part 32B and the structure part 32C, between the structure part 32C and the structure part 32D, and between the structure part 32D and the right side wall 38. The notches 34 are symmetrically disposed in the width direction y. The notches 34 are provided corresponding to the rear side of the mating portion 10 in a plan view. In other words, the notch 34A is disposed posterior to the mating part 10A, the notch 34B is disposed posterior to the mating part 10B, the notch 34C is disposed posterior to the mating part 10C, the notch 34D is disposed posterior to the mating part 10D, and the notch 34E is disposed posterior to the mating part 10E.

The notches 34A, 34B, 34C, 34D, and 34E are respectively housed in ranges occupied by the corresponding mating parts 10A, 10B, 10C, 10D, and 10E in the width direction y, as shown in FIGS. 2A and 2C. As a result, virtual lines of the structure parts 32 that extend forward from both side walls in the front-rear direction x intersect with the two mating parts 10 adjacent to each other; as shown in FIG. 3A, in the structure part 32A, virtual lines L1 and L2 that extend forward from both side walls in the front-rear direction x interfere with the mating part 10A and the mating part 10B.

In an embodiment, the positional relationship between the structure parts 32 and the mating portion 10 is defined as overlapping of each of the structure parts 32 with two corresponding mating parts 10 in the front-rear direction x. For example, the structure part 32A is overlapped with the corresponding mating parts 10A and 10B in the front-rear direction x, and the other structure parts 32B, 32C, and 32D are also overlapped with corresponding mating parts in a similar manner. In the present embodiment, an overlapping dimension of the structure part 32A with the mating part 10A in the width direction y and an overlapping dimension of the structure part 32A with the mating part 10B in the width direction y are equal to each other.

The connector housing 1, as shown in FIGS. 3A and 3B, includes a first feature that the structure parts 32 are provided to approximate the volume of the front side and the volume of the rear side to each other, and a second feature that the notches 34 are provided between the structure parts 32, to control the flow of the melted resin such that warpage hardly occurs. The first feature contributes to reduction of the warpage B shown in FIG. 3A. The first feature and the second feature are described below in this order.

The first feature will now be described with reference to FIG. 3A. When the connector housing 1 is segmented into the mating portion 10 on the front side and the cover 30 on the rear side with the holding portion 20 as a boundary A, a ratio of a volume V1 of the fiber reinforced plastic configuring the mating portion 10 and a volume V2 of the fiber reinforced plastic configuring the cover 30 is set to V1:V2=1.2:1.0. As described in a comparative example described below and shown in FIGS. 4A and 4B, in another connector housing 100, the volume of the mating portion on the front side commonly includes 1.5 or more times of the volume of the cover on the rear side. In contrast, in the connector housing 1 according to the present embodiment, the volume on the front side and the volume on the rear side are approximated to each other. In an embodiment, the ratio is set to V1:V2=1.2:1.0; however, occurrence of the warpage can be reduced when the ratio is set within a range of V1:V2=1.0:1.0 to 1.4:1.0, and occurrence of the warpage can be further reduced when the ratio is set within a range of V1:V2=1.0:1.0 to 1.1:1.0.

In the connector housing 1 according to the present embodiment, the volume on the front side and the volume on the rear side are approximated to each other by providing the plurality of structure parts 32 on the cover 30, and warpage occurring on the connector housing 1 after injection molding is accordingly reduced. In other words, the volume on the front side and the volume on the rear side are approximated to each other, which prevents the cover 30 from being pulled by the mating portion 10 after injection molding. As a result, it is possible to make the warpage B shown in FIG. 3A small.

The structure parts 32 are formed in consideration of the notches 34 provided as the second feature. In the injection molding of the fiber reinforced plastic of the connector housing 1, contracting force of the resin injected into a cavity of a mold in a direction perpendicular to a flowing direction of the resin is strong. In the present embodiment, the warpage B is reduced by balancing the contracting force.

As shown in FIG. 3A, in the connector housing 1, the notches 34 are provided adjacently to the structure parts 32. As shown in FIG. 3B, the structure part 32A is disposed between the notch 34A and the notch 34B. When the connector housing 1 is fabricated through injection molding, a gate G through which the melted resin containing reinforcing fibers is injected into the cavity of the mold is provided on each of both ends in the width direction y as shown in FIG. 3B, and the resin is injected in the arrow direction. Only the gate G on one side is shown in FIG. 3B.

A flowing state and contraction after the injection molding of the melted resin around the structure part 32A are described below with reference to FIG. 3B.

First, in a region from the mating part 10A to the mating part 10B, as illustrated by an arrow F1, the melted resin flows so as to protrude rearward in the middle between the mating part 10A and the mating part 10B. According to the flow F1, post-shrinkage C occurs on an inside of the flow F1. Next, in a region between the mating part 10A and the structure part 32A, the melted resin forms a flow F2 along a corner of the notch 34A on the structure part 32A side as illustrated by an arrow F2. According to the flow F2, the post-shrinkage C occurs on an inside of the flow F2. Next, in a region between the structure part 32A and the mating part 10B, the melted resin forms a flow F3 along a corner of the notch 34B on the structure part 32A side as illustrated by an arrow F3. According to the flow F3, the post-shrinkage C occurs on the inside of the flow F2.

As described above, as for the surroundings of one structure part 32A, the flow F1, the flow F2, and the flow F3 move in different directions from one another, which does not cause a flow biased to a specific direction between the mating part 10A and the mating part 10B. When considered with respect to the whole of the connector housing 1 in the width direction y, it is possible to suppress the warpage B.

A connector housing 100 according to a comparative example that includes a mating portion 110 configured to be mated with a mating electrical connector, a holding portion 120 holding terminals, and a cover 130 covering the terminals drawn out of the holding portion 120 is shown in FIG. 4A. The mating portion 110 is fabricated in a manner similar to the mating portion 10 according to the present invention. In contrast, the cover 130 does not include the structure parts 32 and the notches 34, and includes a plate-like upper wall 131, and a left side wall 132 and a right side wall 133 both extending from the upper wall 131.

In a region between a mating part 110A and a mating part 110B, the melted resin injected through the gate G, as shown in FIG. 4B, flows so as to protrude rearward in the middle between the mating part 110A and the mating part 110B as illustrated by a flow F. The direction of the flow F is not basically changed in the front-rear direction x while being increased in curvature on the rear side. Accordingly, the connector housing 100 forms a mode in which post-shrinkage C occurs only on an inside of the flow F between the mating part 110A and the mating part 110B. When the matter is considered with respect to the whole of the connector housing 1 in the width direction y, the warpage B is increased.

The connector housing 1 reduces the warpage B by 60% as compared with the connector housing 100. The connector housing 1 and the connector housing 100 each have a dimension in the width direction y of about 200 mm, and have the same shape and the same dimensions except that the structure of the cover 30 and the structure of the cover 130 are different from each other.

As described above, in the connector housing 1, the structure parts 32A, 32B, 32C, and 32D are symmetrically disposed in the width direction y, and the notches 34A, 34B, 34C, 34D, and 34E are symmetrically disposed in the width direction y. In other embodiments, the structure parts 32 and the notches 34 may be asymmetrically disposed as long as the volume on the front side and the volume on the rear side are approximated to each other and the melted resin is controlled so as not to flow in the direction causing the warpage B at the rear structure portion. Accordingly, the shapes and the dimensions of the plurality of structure parts 32 and the plurality of notches 34 may be different from one another.

In the connector housing 1, each of the structure parts 32 is overlapped with the two corresponding mating parts 10 in the width direction y. In other embodiments, each of the structure parts 32 is not overlapped with the two corresponding mating parts 10 in the width direction y.

What is claimed is:

1. A connector housing, comprising:

a mating portion including a plurality of mating hoods that are arranged in a width direction on a front side of the connector housing that is configured to be mated with a mating connector; and a rear structure portion disposed posterior to the mating portion and including:

a plurality of structure parts each disposed in overlapping alignment in a front-rear direction between two mating hoods adjacent to each other of the plurality of mating hoods; and a plurality of notches each disposed between two structure parts adjacent to each other of the plurality of structure parts, wherein the plurality of mating hoods are symmetrically disposed in the width direction, and the plurality of structure parts and the plurality of notches are symmetrically disposed in the width direction.

2. The connector housing of claim 1, wherein each of the plurality of structure parts includes a plurality of lightening parts each having an opening.

3. The connector housing of claim 2, wherein each of the plurality of structure parts is formed in a point-symmetrical shape.

4. The connector housing of claim 1, wherein the mating portion and the rear structure portion are each formed of a fiber reinforced resin.

5. The connector housing of claim 3, wherein the mating portion and the rear structure portion are each formed of a fiber reinforced resin.

6. The connector housing of claim 1, wherein the following expression is satisfied:

$$V1:V2=1.0:1.0 \text{ to } 1.4:1.0$$

where V1 is a volume occupied by the mating portion and V2 is a volume occupied by the rear structure portion.

7. The connector housing of claim 3, wherein the following expression is satisfied:

$$V1:V2=1.0:1.0 \text{ to } 1.4:1.0$$

where V1 is a volume occupied by the mating portion and V2 is a volume occupied by the rear structure portion.

8. The connector housing of claim 4, wherein the following expression is satisfied:

$V1:V2=1.0:1.0$ to $1.4:1.0$ where V1 is a volume occupied by the mating portion and V2 is a volume occupied by the rear structure portion.

9. The connector housing of claim 5, wherein the following expression is satisfied:

$V1:V2=1.0:1.0$ to $1.4:1.0$ where V1 is a volume occupied by the mating portion and V2 is a volume occupied by the rear structure portion.

10. The connector housing of claim 1, wherein each of the plurality of structure parts overlaps with the two mating hoods adjacent to each other in a front-rear direction perpendicular to the width direction.

* * * * *